United States Patent [19]

Onodera

[11] Patent Number: 4,766,952

[45] Date of Patent: Aug. 30, 1988

[54] WASTE HEAT RECOVERY APPARATUS

[75] Inventor: Kagetoshi Onodera, Chiba, Japan

[73] Assignee: The Furukawa Electric Co., Ltd., Japan

[21] Appl. No.: 861,536

[22] Filed: May 9, 1986

[30] Foreign Application Priority Data

| | | | |
|---|---|---|---|
| Nov. 15, 1985 | [JP] | Japan | 60-175620[U] |
| Dec. 27, 1985 | [JP] | Japan | 60-200874[U] |
| Jan. 13, 1986 | [JP] | Japan | 61-1994[U] |
| Feb. 27, 1986 | [JP] | Japan | 61-27840[U] |

[51] Int. Cl.[4] ..... F28G 1/02; F28G 1/16

[52] U.S. Cl. ..... 165/95; 165/901; 122/391

[58] Field of Search ..... 165/95, 901; 122/390, 122/391, 392, 405

[56] References Cited

U.S. PATENT DOCUMENTS

| | | | |
|---|---|---|---|
| 2,683,590 | 7/1954 | Baver | 165/95 |
| 2,791,400 | 5/1957 | Riehl | 165/95 |
| 2,832,571 | 4/1958 | Baver | 165/921 X |
| 4,031,862 | 6/1977 | Smith | 122/392 X |

FOREIGN PATENT DOCUMENTS

| | | | |
|---|---|---|---|
| 581874 | 8/1933 | Fed. Rep. of Germany | 165/95 |
| 88256 | 1/1896 | Fed. Rep. of Germany | 165/95 |
| 1276751 | 4/1902 | France | 165/95 |
| 686746 | 7/1930 | France | 165/95 |
| 1403415 | 5/1965 | France | 165/95 |
| 38454 | 3/1980 | Japan | 165/95 |
| 84996 | 5/1982 | Japan | 165/95 |
| 164838 | 6/1921 | United Kingdom | 165/95 |
| 463603 | 4/1937 | United Kingdom | 165/95 |

*Primary Examiner*—Ira S. Lazarus
*Assistant Examiner*—Peggy Neils
*Attorney, Agent, or Firm*—Frishauf, Holtz, Goodman & Woodward

[57] ABSTRACT

A waste heat recovery apparatus comprising a high-temperature unit including a high-temperature casing having an inlet through which an exhaust gas is introduced into the unit and an outlet through which the exhaust gas is discharged from the unit, a set of heat exchanger tubes arranged in the high-temperature casing, and a dry-type cleaner for removing dust on the heat exchanger tubes, a low-temperature unit including a low-temperature casing having an inlet through which the exhaust gas is introduced into the unit and an outlet through which the exhaust gas is discharged from the unit, a set of heat exchanger tubes arranged in the low-temperature casing, and a flush-type cleaner for removing dust on the heat exchanger tubes by spraying flushing water on the tubes, an intermediate duct connecting the outlet of the high-temperature unit and the inlet of the low-temperature unit so that the exhaust gas from the high-temperature unit is passed into the low-temperature unit through the intermediate duct, an exhaust duct connected to the outlet of the low-temperature unit so that the exhaust gas is discharged from the low-temperature unit through the exhaust duct, a by-pass duct connecting the intermediate duct and the exhaust duct, first damper for controlling the flow of the exhaust gas from the intermediate duct to the low-temperature casing, and second damper for controlling the flow of the exhaust gas from the intermediate duct to the by-pass duct.

12 Claims, 6 Drawing Sheets

WASTE HEAT RECOVERY APPARATUS

BACKGROUND OF THE INVENTION

The present invention relates to a waste heat recovery apparatus such as economizer and heat pipe type air preheater for recovering waste heat from exhaust gas (below 400° C.) discharged from heavy oil fired boilers and the like.

Conventionally, in recovering waste heat from exhaust gas, which results from the combustion of heavy oil, by means of a heat exchanger such as economizer, the gas is introduced into a casing containing a set of heat exchanger tubes, and water is fed into the tubes so that it is heated by the gas. Thereupon, the heat exchanger tubes may be corroded by sulfuric acid contained in the exhaust gas, or be coated with dust to cause an exhaust gas passage to be closed. The inventor of the present application considered a waste heat recovery apparatus comprising a high-temperature-side casing unit (hereinafter referred to as high-temperature unit) containing a set of heat exchanger tubes, a low-temperature-side casing unit (hereinafter referred to as low-temperature unit) containing another set of heat exchanger tubes, and an intermediate duct connecting the two units. In cooling exhaust gas from about 200° C. to about 100° C. by a heat exchanger and then discharging it into the outside air, the gas of about 145° to 200° C. is introduced into the high-temperature unit, while the gas of about 100° to 140° C. is passed into the low-temperature unit. In order to remove dust on the heat exchanger tubes, in the apparatus of this type, a dry-type cleaner or dust cleaning device and a flush-type cleaner or dust cleaning device are used in the high- and low-temperature units, respectively. The apparatus is subject to drawbacks as follows. When the heat exchanger tubes are showered frontally and from above by means of a spraying tube of the flush-type cleaner, flushing water comes into contact with the exhaust gas, casing, and heat exchanger tubes on the low-temperature unit side to produce steam. The steam fills the intermediate duct, moistening dust on the duct and the heat exchanger tubes on the rear side of the high-temperature unit. This is caused because the exhaust gas flow is temporarily retarded by the flushing water, allowing the steam to flow back into the high-temperature unit. As a result, in the dry-type cleaner of the high-temperature unit, the sweep resistance of cleaner blades is increased by the wet dust on the heat exchanger tubes. Thus, the blades are deformed and disabled from effecting a satisfactory cleaning. The dust on the heat exchanger tubes accumulates to close the gas passage and corrode the casing of the high-temperature unit.

In general, the casing of the high-temperature unit may be formed of stainless steel or sulfuric-acid-resisting steel; the casing of the low-temperature unit of a steel plate with lead-plate lining in contact surfaces of exhasut gas or FRP (fiberglass reinforced plastic), and the intermediate duct of a steel plate with lead-plate lining in contact surfaces of exhaust gas, FRP or stainless steel.

As another problem, in boilers used in cold districts, if a stainless steel stack is used without a smoke desulfurization system, the temperature of exhaust gas discharged into the air is kept at more than about 160° C. at its exhaust port to prevent corrosion at the dew point of sulfuric acid. If the inlet-temperature of exhaust gas is lower by low load of boiler in summer, therefore, the waste heat recovery apparatus cannot be operated due to a lower outlet-temperature of exhaust gas.

SUMMARY OF THE INVENTION

The object of the present invention is to provide a waste heat recovery apparatus, in which steam produced during the removal of dust on heat exchanger tubes by showering in a low-temperature unit is prevented from flowing back into a high-temperature unit.

BRIEF DESCRIPTION OF THE DRAWINGS

FIGS. 6 to 8 show a dry-type cleaner used in a high-temperature unit, in which FIG. 6 is a general side view, FIG. 7 is a side view showing cleaning members, and FIG. 8 is a plan view;

FIG. 10 is a sectional view, FIG. 11 is a cutaway side view, and FIG. 12 is a sectional view of the cleaner built in a casing.

DETAILED DESCRIPTION OF THE PREFERRED EMBODIMENT

A waste heat recovery apparatus suitable for recovering waste heat from exhaust gas due to the combustion of heavy oil according to an embodiment of the present invention will now be described in detail with reference to the accompanying drawings.

Figure 1:
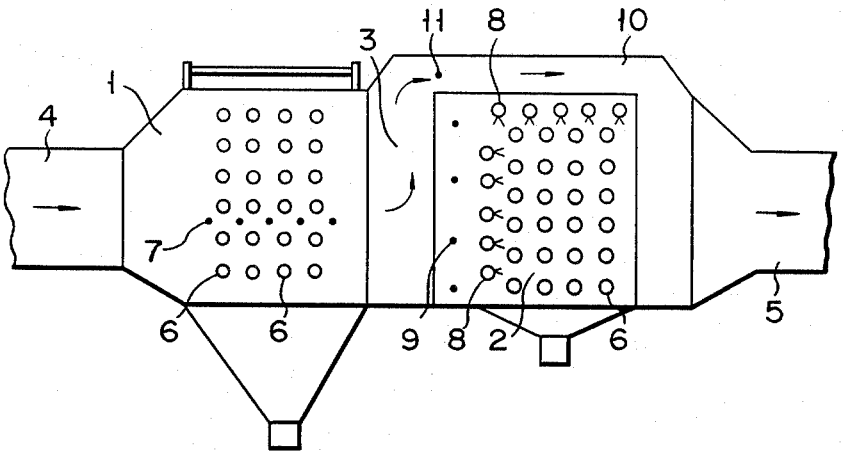
FIG. 1 is a schematic view of a waste heat recovery apparatus according to an embodiment of the present invention.

Referring now to FIG. 1, there are shown high-temperature unit 1, low-temperature unit 2, and intermediate duct 3 with an inspection hole disposed between the two units. Supply duct 4 connected to a boiler (not shown) is coupled to the inlet of unit 1. Exhaust duct 5 connected to a stack (not shown) is coupled to the outlet of unit 2. Intermediate duct 3 is airtightly connected between the outlet of unit 1 and the inlet of unit 2. Thus, exhaust gas resulting from the combustion of heavy oil in the boiler, containing dust and sulfur oxide, flows successively through supply duct 4, high-temperature unit 1, intermediate duct 3, low-temperature unit 2, and exhaust duct 5, and is then discharged into the air through the stack. Units 1 and 2 each contain a set of heat exchanger tubes or heat pipes 6 which extend at right angles to the flowing direction of the exhaust gas, and are arranged in the form of a matrix. The heat exchanger tube may be constructed by an inner tube of 25.4 mm diameter formed of copper or steel or stainless steel, an intermadiate layer mounted on the outer periphery of the inner tube and formed of a lower melting point metal such as solder, tin and lead, and an outer tube of 29.0 mm diameter made of lead or lead alloy mounted through the intermediate layer on the inner tube and metallurgically bonded with the intermediate layer when the lower melting point metal is melted.

Unit 1 contains dry-type cleaner 7 (described in detail later) for brushing off dust on the outer peripheral surfaces of tubes 6. Unit 2 contains flush-type cleaner 8 (mentioned in detail later) which spouts flushing water onto the heat exchanger tubes from above and frontally. The flushing water washes off dust on the outer peripheral surfaces of tubes 6. First damper 9 is provided between low-temperature unit 2 and intermediate duct 3, whereby the flow of the exhaust gas from duct 3 into unit 2 is controlled. By-pass duct 10 is connected between ducts 3 and 5. The exhaust gas flowing from duct 3 to duct 5 passes through duct 10 without flowing through unit 2. Duct 10 contains second damper 11 for controlling the exhaust gas flow therein.

First and second dampers 9 and 11 may be acid resisting type damper used. These dampers may be controlled manually or interlinked with flush-type cleaner 8 so that they are actuated automatically when the cleaner starts to be used.

In the normal heat exchange process, in the waste heat recovery apparatus described above, first and second dampers 9 and 11 are opened and closed, respectively. As a result, the exhaust gas from high-temperature unit 1 flows through low-temperature unit 2, where it undergoes a heat exchange with the water in heat exchanger tubes 6 and is then introduced into exhaust duct 5. In the cleaning process, dampers 9 and 11 are closed and opened, respectively, and the flushing water is jetted from the flush-type cleaner against tubes 6 to wash off dust from the outer peripheral surfaces of the tubes. Meanwhile, the exhaust gas from unit 1 flows into duct 5 through by-pass duct 10. Since damper 9 is closed, steam in unit 2 is prevented from flowing through intermediate duct 3 into unit 1.

Although the first and second dampers have been described simply as being opened and closed, it is to be understood that the opening and closing may include partial opening and closing, as well as 100 percent ones.

In the cool or cold seasons, first and second dampers 9 and 11 are closed and opened, respectively. In the warm or hot seasons, on the other hand, the respective openings of the two dampers are adjusted so that the exhaust gas temperature at the outlet of the stack is above the dew point of sulfuric acid Constructed in this manner, the waste heat recovery apparatus of the present invention provides the following effects.

(1) During the flushing of low-temperature unit 2, steam is prevented from flowing back into high-temperature unit 1, so that dust in unit 1 cannot moisten. In unit 1, therefore, dry-type cleaner 7 can be operated smoothly, and the dust can be removed with ease.

(2) Waste heat can always smoothly be collected without regard to the temperature of the exhaust gas introduced into unit 2.

The individual components of the aforementioned waste heat recovery apparatus will now be described further in detail.

Figure 2:
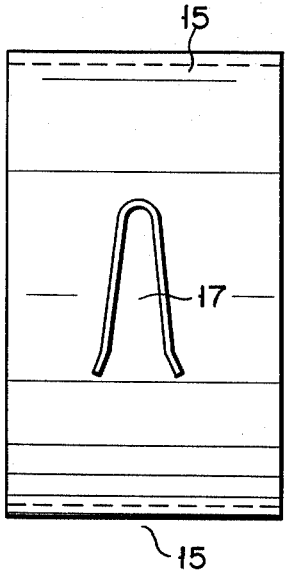
FIGS. 2 and 3 are a side view and a sectional view, respectively, showing a supporting tube used to support a heat exchanger tube of the waste heat recovery apparatus.
Figure 3:
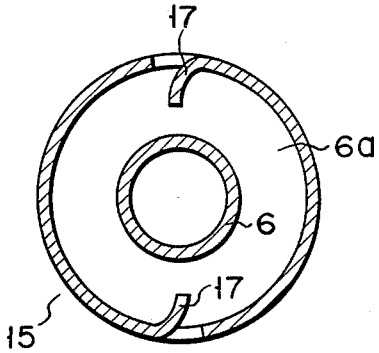
Figure 4:
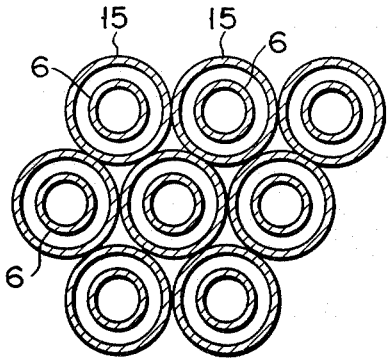
FIGS. 4 and 5 are a side view and a cross sectional view, showing a set of heat pipes or heat exchanger tubes arranged with the aid of supporting tubes.
Figure 5:
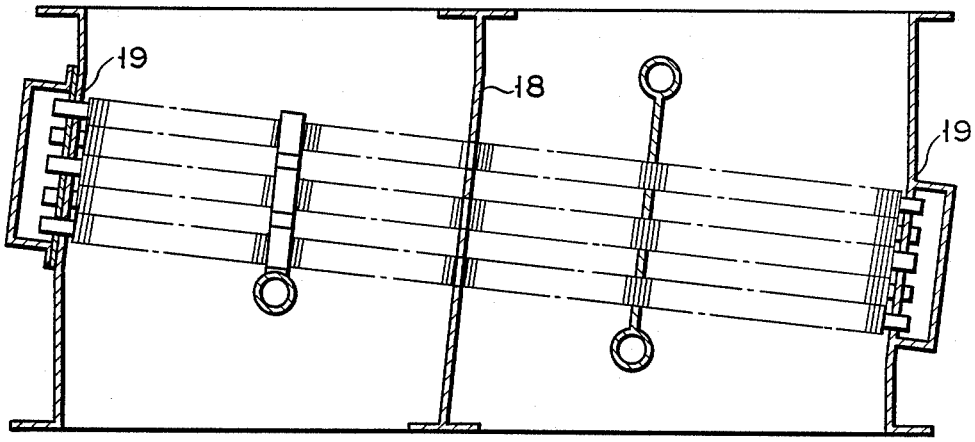

In view of the heat exchanger effectiveness, heat exchanger tubes 6 are preferably formed with a number of fins 6*a* on their outer periphery. If the tubes are increased in number, the fins are liable to get entangled with one another, possibly hindering the replacement of the tubes or the like. Supporting tubes 15, as shown in FIG. 2, are used to prevent such an awkward situation. Each tube 15 is a lead alloy tube which has an inside diameter approximately 1 mm longer than the outside diameter of the fins, a wall thickness of about 3 mm and a width of about 30 mm, and is formed with V-shaped slits 16 in either side wall thereof. After inserting heat exchanger tube 6 into supporting tube 15, cut lugs 17 defined by slits 16 are bent so as to be located between fins 6*a* to engage the same, as shown in FIG. 3. Thus partially supported by supporting tubes 15, tubes 6 are fixed to a casing of low-temperature unit 2 so that the outer peripheral surfaces of tubes 15 are in contact with one another, as shown in FIG. 4. In doing this, partition tube plate 18 is attached to the middle portion of the set of tubes 6, and tube plate 19 to each end portion, as shown in FIG. 5. The supporting tubes may be applied to the arrangement of the heat exchanger tubes or heat pipes in low-temperature unit 2.

Referring now to FIGS. 6 to 9, the dry-type cleaner will be described in detail.

Figure 6:
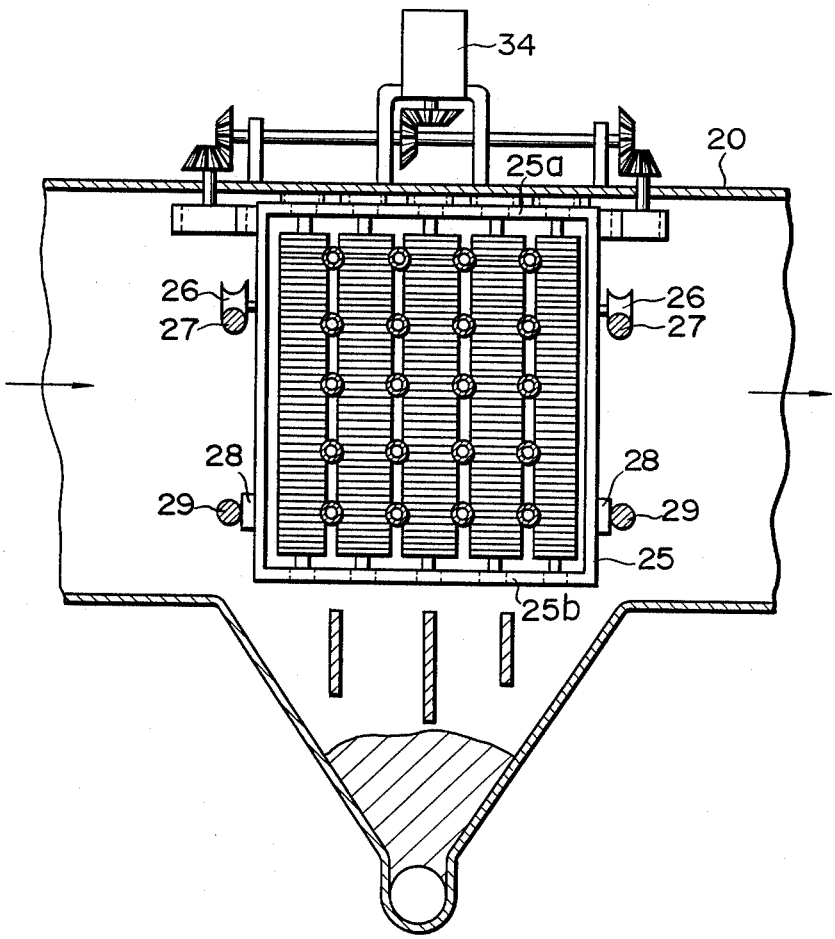
Figure 7:
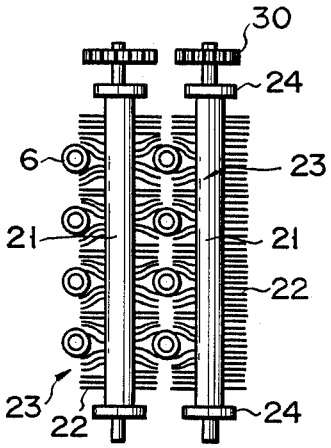
Figure 8:
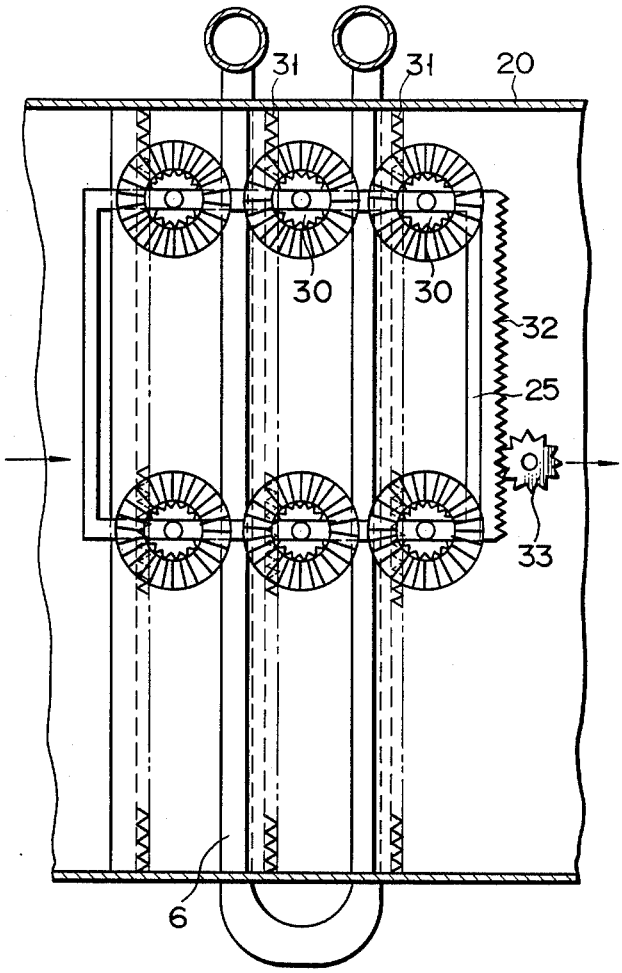

In high-temperature unit 1, as shown in FIG. 6, a number of heat exchanger tubes 6 or heat pipes 6 are arranged horizontally in layers inside casing 20. As shown in FIG. 7, a number of cleaning members 23 stand at regular intervals so as to hold tubes 6 between them. Each member 23 includes stainless steel rod 21 and brush 22 which is attached to the outer peripheral surface of rod 21, forming a cylindrical configuration with a uniform diameter. Brush 22 are made of fiber or sheet such as glass, carbon, Teflon, stainless steel and etc. The members 23 can rotate about their respective central axes, having their upper and lower end portions rotatably supported on upper and lower frame portions 25*a* and 25*b*, respectively, of box-shaped frame 25 by means of bearings 24. The frame 25 may be constructed by assembling a plurality of stainless steel tubes to form a cage-like construction, thereby not preventing the flow of exhaust gas. As shown in FIG. 6, guide roller 26 is rotatably supported on the upper portion of each side wall of frame 25. Frame 25 can move in the horizontal direction as the paired rollers 26 roll on a pair of first guide rails 27 which extend horizontally and are fixed inside casing 20. Sliding contact member 28 is supported on the lower portion of each side wall of frame 25. Frame 25 is prevented from rolling from side to side during its movement as paired members 28 are in sliding contact with the peripheral surface of a pair of second guide rails 29. As shown in FIG. 8, pinion 30 is coaxially mounted on the upper end portion of each cleaning member 23. It is in mesh with rack 31 which extends horizontally at the upper portion of casing 20. As frame 25 moves in the aforesaid manner cleaning members 23 are automatically rotated through the medium of pinions 30. Rack 32, which is formed on a lateral face of upper frame portion 25*a*, is in mesh with pinion 33 which is rotatably attached to casing 20 and is rotated by reversible motor 34 such as gate valve motor for example (see FIG. 6) with the aid of a bevel gear. Thus, frame 25 is reciprocated by the motor 34.

In the dry-type cleaner described above, all cleaning members 23 are both moved along heat exchanger tubes 6 and rotated by means of motor 34. In this manner, dust on the outer peripheral surfaces of tubes 6 can be removed with success.

Figure 9:
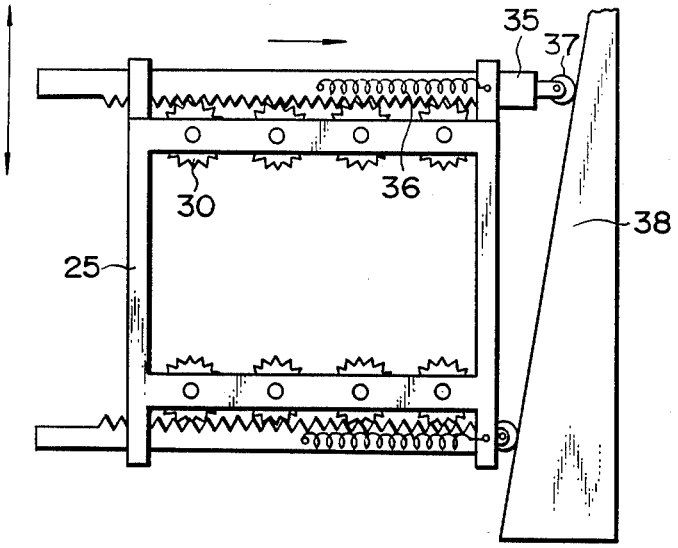
FIG. 9 is a plan view showing a modification of the dry-type cleaner.

The drive mechanism for cleaning members 23 may be constructed as shown in FIG. 9.

In this example, frame 25 is provided with rack 35 which extends horizontally at right angles to the moving direction of the frame and can move in its extending direction. Rack 35 is in mesh with pinions 30 of members 23, and is urged in the direction of the arrow of FIG. 9 by tension spring 36. Guide roller 37 is rotatably supported on one end of rack 35. It is fixed on casing 20 and caused to be in rolling contact with a slant surface or cam face 38 by the urging force of spring 36. Thus, when frame 25 moves at right angles to the direction of the arrow, roller 37 rolls along cam face 38, so that rack 35 moves opposite to the direction of the arrow, resisting the urging force of spring 36. As a result, members 23 are rotated through the medium of pinions 30.

Figure 10:
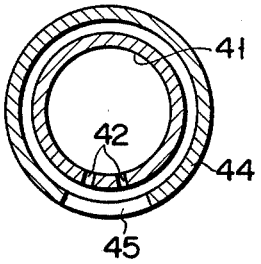
FIGS. 10 to 12 show a flush-type cleaner used in a low-temperature unit.
Figure 11:
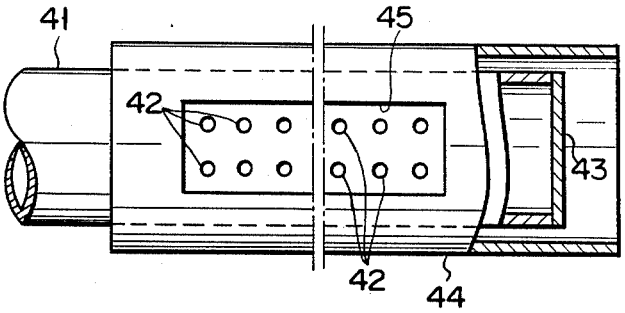
Figure 12:
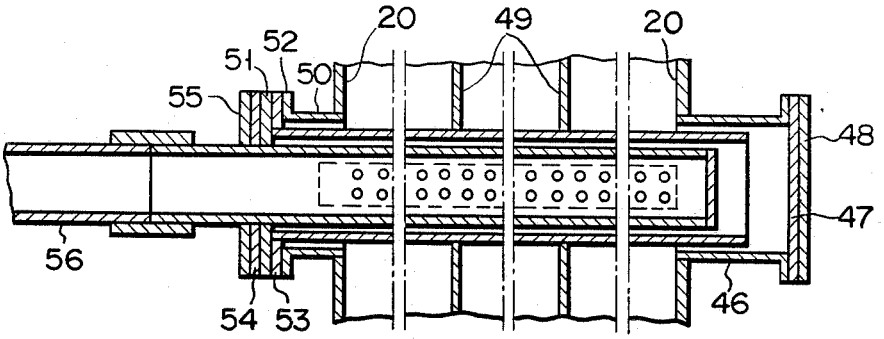

Referring now to FIGS. 10 to 12, the flush-type cleaner will be described in detail.

In these drawings, numeral 41 designates an inner tube formed of an acid- and heat-resisting plastic material, such as fluorine-contained polymer. Spraying nozzles 42 with a fixed diameter (2 to 5 mm) are formed in the bottom portion of tube 41, spaced at regular intervals in the longitudinal direction of the tube. In consideration of the relationship between the cleaning effect and the density of spraying tubes attached to the waste heat recovery apparatus, nozzles 42 are arranged in two rows. Alternatively, however, the nozzles may be arranged in one or three rows, depending on the spraying tube density.

Numeral 44 designates an outer tube formed of a steel or stainless steel tube, which has an inside diameter a little greater than the outside diameter of inner tube 41. The difference between the two diameters should be set so that it allows thermal expansion of tube 41 but prevents its deformation. Oute tube 44 is fitted on inner tube 41 so as to cover that part of tube 41 formed with nozzles 42 and that portion to which end cap 43 is fixed. Tube 44 is formed with window 45 which faces nozzles 42 in a manner such that it does not prevent water spraying from the nozzles. The outer tube is completely lined (not shown) for acid- and heat-resisting properties by, for example, bake-coating with fluorine-contained polymer. In this embodiment, window 45 is formed of an opening cut only in that portion of outer tube 44 which faces nozzles 42. Alternatively, however, the window may be formed so as to extend continuously to the end portion of tube 44, or be in the form of discontinuous apertures, provided the water spraying from nozzles 42 is not prevented.

Although cylindrical tubes are used for inner and outer tubes 41 and 44 in the above embodiment, tubes of any other sectional shapes may be used for that purpose, provided they ensure satisfactory water spraying from nozzles 42.

The spraying tubes are mounted in the upper portion of casing 20 which defines an outline of low-temperature unit 2, that is, over the set of heat exchanger tubes 6, as shown in FIG. 12. In FIG. 12, one end portion of a spraying tube is supported by a cylindrical socket portion 46 which is attached to casing 20. The end of socket portion 46 is closed by lid plate 48 which is lined with gasket 47. Plate 48 and the closed end portion of inner tube 41 are suitably spaced. The middle portion of the spraying tube is penetratingly supported by support plates 49 in the upper portion of casing 20. It is also supported by cylindrical socket portion 5 at the other end portion of casing 20, projecting from the casing. At the other end portion of the spraying tube, flange 51 is mounted on inner tube 41 so as to be in contact with the end of outer tube 44. The flange is screwed to flange 52 at the end of socket portion 50, pressed by backup plate 55 with the aid of gaskets 53 and 54. The projecting end portion of inner tube 41 is coupled to an end of water supply pipe 56. In this state, water is fed into inner tube 41 of the spraying tube and used to remove dust on the outer peripheral surfaces of heat exchanger tubes 6. Tube 41 is expanded in both its circumferential and longitudinal directions by waste heat. When it contracts, its deformation is prevented by outer tube 44. Lined for acid- and heat-resisting properties, moreover, tube 44 is prevented or restrained from corroding.

Figure 13:
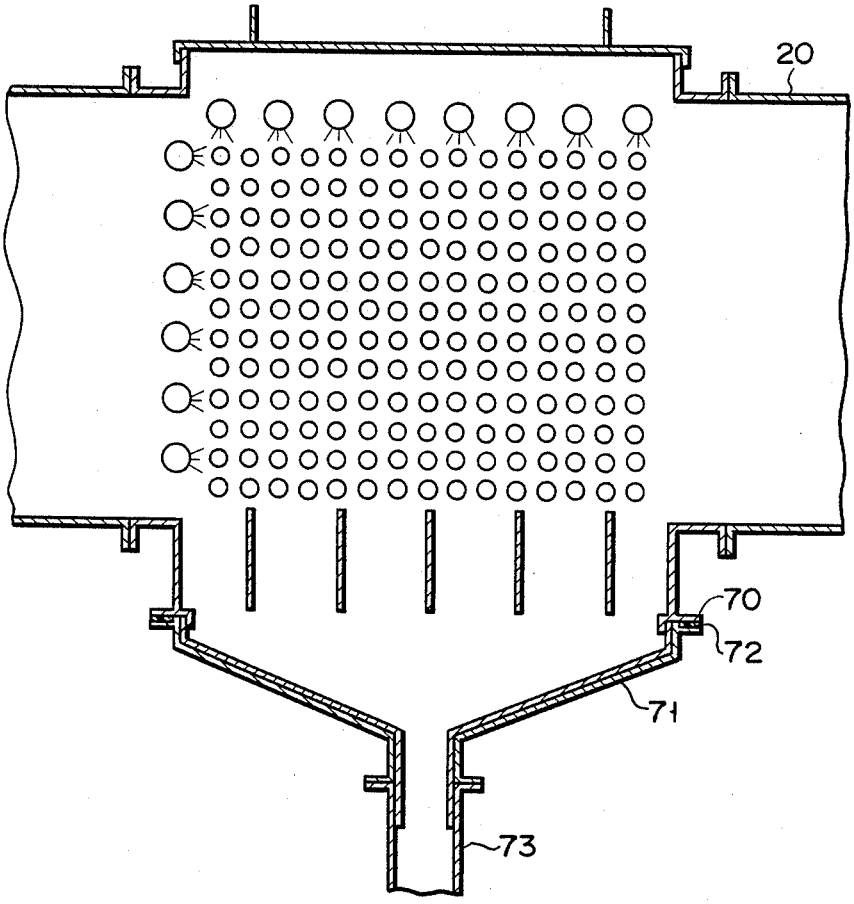
FIG. 13 is a sectional view showing the lower part of the casing of the low-temperature unit.

Referring now to FIG. 13, the construction of the lower part of the casing of low-temperature unit 2 will be described.

Casing 20 includes a casing body with an opening at the bottom portion and bottom plate 71 facing the opening. Flange 70 is formed on the periphery of the bottom opening. Plate 71, which is formed of FRP or steel plate with lead plate lining, is hopper-shaped or tapered so as to close the opening. Flange 72 engages the top opening of plate 71 through the medium of flange 70 and a gasket, thereby sealing the opening in a liquid-tight manner. A small opening is formed in the central portion of the bottom end of bottom plate 71. It is connected with drain tube 73 made of stainless steel or polyvinyl chloride. In case of bottom plate 71 made of FRP, an acid- and heat-resisting plate, formed of firestone, ceramics, glass pottery or Teflon, is attached to the inside of plate 71 with such as adhesive to protect it against heat and corrosion. The bottom plate 71 may be constructed by forming or gradient to flow water in a steel plate with lead alloy metal lining. In case of bottom plate made of steel plate with lead plate lining, the upper surface of lead plate is covered with an acid-resisting castable refractories of about 60 mm thickness. On the castable refractories, drain drainage channels of stainless steel is changeably mounted.

What is claimed is:

1. A waste heat recovery apparatus comprising:

a high-temperature unit including a high-temperature casing having an inlet through which an exhaust gas is introduced into the unit and an outlet through which the exhaust gas is discharged from the unit, a set of heat exchanger tubes arranged in the high-temperature casing, and a dry-type cleaner for removing dust on the heat exchanger tubes;

a low-temperature unit including a low-temperature casing having an inlet through which the exhaust gas is introduced into the unit and an outlet through which the exhaust gas is discharged from the unit, a set of heat exchanger tubes arranged in the low-temperature casing, and a flush-type cleaner for removing dust on the heat exchanger tubes by spraying flushing water on the tubes;

an intermediate duct connecting the outlet of the high-temperature unit and the inlet of the low-temperature unit so that the exhaust gas from the high-temperature unit is passed into the low-temperature unit through the intermediate duct;

an exhaust duct connected to the outlet of the low-temperature unit so that the exhaust gas is discharged from the low-temperature unit through the exhaust duct;

a by-pass duct connecting the intermediate duct and the exhaust duct;

first damper mean for controlling the flow of the exhaust gas from the intermediate duct to the low-temperature casing; and second damper means for controlling the flow of the exhaust gas from the intermediate duct to the by-pass duct.

2. The waste heat recovery apparatus according to claim 1, wherein said first damper means is disposed in the low-temperature casing on a side along the intermediate duct.

3. The waste heat recovery apparatus according to claim 2, wherein said second damper means is disposed in the by-pass duct.

4. The waste heat recovery apparatus according to claim 3, wherein said flush-type cleaner is disposed in the low-temperature casing so that the flushing water is jetted against the set of heat exchanger tubes from above the same and from the intermediate duct side.

5. The waste heat recovery apparatus according to claim 1, wherein said heat exchanger tubes are each formed with fins on the outer peripheral surface thereof, and are partially inserted and fixed in supporting tubes which are supported in contact with one another in the low-temperature casing 6. The waste heat recovery apparatus according to claim 5, wherein each said supporting tube is formed, on the peripheral wall thereof, with cut lugs bent inward to engage the fins of the corresponding heat exchanger tube.

7. The waste heat recovery apparatus according to claim 1, wherein said dry-type cleaner includes a number of cleaning members disposed between the heat exchanger tubes for rotation and movement in a longitudinal direction of the tubes, and adapted to touch and brush off dust on outer peripheral surfaces of the tubes, and a drive mechanism for rotating and moving the cleaning members in the longitudinal direction of the tubes.

8. The waste heat recovery apparatus according to claim 7, wherein said drive mechanism includes a frame disposed in the high-temperature casing for movement in the longitudinal direction of the heat exchanger tubes and rotatably supporting the cleaning members, transport means for moving the frame in said direction, and rotating means for rotating the cleaning members as the frame moves in said direction.

9. The waste heat recovery apparatus according to claim 1, wherein said flush-type cleaner includes an inner tube having a number of nozzles through which the flushing water is jetted, and an outer tube coaxially surrounding the inner tube to protect the same and having a window facing the nozzles so that the flushing water jetted from the nozzles passes through the window.

10. The waste heat recovery apparatus according to claim 9, wherein said inner tube is made of an acid- and heat-resisting plastic material and said outer tube is formed of steel or stainless steel and lined for acid- and heat-resisting properties.

11. The waste heat recovery apparatus according to claim 1, wherein each of the heat exchanger tubes of at least low-temperature unit includes an inner tube of metal and an outer tube covering the inner tube and made of lead alloy metallurgically bonded to the inner tube.

12. A waste heat recovery method for use with a high temperature unit comprising a high-temperature unit including a high-temperature casing having an inlet through which an exhaust gas is introduced into the unit and an outlet through which the exhaust gas is discharged from the unit, a set of heat exchanger tubes arranged in the high-pressure casing, and a dry-type cleaner for removing dust on the heat exchanger tubes; a low-temperature unit including a low-temperature casing having an inlet through which the exhaust gas is introduced into the unit and an outlet through which the exhaust gas is discharged from the unit, a set of heat exchanger tubes arranged in the low-temperature casing, and a flush-type cleaner for removing dust on the heat exchanger tubes by spraying flushing water on the tubes; an intermediate duct connecting the outlet of the high-temperature unit and the inlet of the low-temperature unit so that the exhaust gas from the high-temperature unit is passed into the low-temperature unit through the intermediate duct; an exhaust duct connected to the outlet of the low-temperature unit so that the exhaust gas is discharged from the low-temperature unit through the exhaust duct; a by-pass duct connecting the intermediate duct and the exhaust duct; first damper means for controlling the flow of the exhaust gas from the intermediate duct to the low-temperature casing; and second damper means for controlling the flow of the exhaust gas from the intermediate duct to the by-pass duct, said method comprising the steps of:

(a) at least partially closing said first damper means from an open position while at least partially opening said second damper means from a closed position for blocking flow from said low temperature unit into the intermediate duct while permitting flow from the high temperature unit through the intermediate duct into the by-pass duct, (b) cleaning the low-temperature unit with said flush-type cleaner, and (c) returning the first and second damper means to their respective open and closed positions.

* * * * *